US005209684A

United States Patent [19]

Mondek et al.

[11] Patent Number: 5,209,684

[45] Date of Patent: May 11, 1993

[54] MARINE PROPULSION DEVICE

[75] Inventors: Martin J. Mondek, Wonder Lake; Lawrence E. Zdanowicz, Waukegan, both of Ill.

[73] Assignee: Outboard Marine Corporation, Waukegan, Ill.

[21] Appl. No.: 726,157

[22] Filed: Jul. 1, 1991

[51] Int. Cl.[5] ..... B63H 5/06

[52] U.S. Cl. ..... 440/83; 440/49; 440/79; 440/900

[58] Field of Search ..... 415/104, 107; 416/244 B, 93 R, 93 A, 204 R, 204 A; 440/49, 83, 78, 79, 900; 192/109 R

[56] References Cited

U.S. PATENT DOCUMENTS

| | | | |
|---|---|---|---|
| 2,948,252 | 8/1960 | Alexander | 416/93 A |
| 3,246,698 | 4/1966 | Kiekhaefer | 416/93 A |
| 3,335,803 | 8/1967 | Van Ranst | 170/135.75 |
| 3,389,558 | 6/1966 | Hall | 60/221 |
| 3,444,932 | 5/1967 | Wlezien | 170/160.54 |
| 3,577,628 | 5/1971 | Bunyan | 416/244 B |
| 3,748,061 | 7/1973 | Henrich | 416/93 A |
| 3,759,076 | 9/1973 | Reese | 70/232 |
| 3,876,332 | 4/1975 | Kashmerick | 416/93 |
| 3,894,621 | 7/1975 | Quick | 192/109 R |
| 4,306,867 | 12/1981 | Finze | 440/49 |
| 4,317,655 | 3/1982 | Schiek | 440/49 |
| 4,486,181 | 12/1984 | Cavil | 440/49 |
| 4,498,874 | 2/1985 | Pichl | 440/83 |
| 4,545,771 | 10/1985 | Iio | 440/89 |
| 4,566,855 | 1/1986 | Costabile et al. | 416/134 |
| 4,642,057 | 2/1987 | Frazzell et al. . | |
| 4,778,419 | 10/1988 | Bolle et al. | 440/49 |
| 4,793,773 | 12/1988 | Kinouchi et al. | 416/129 |
| 4,900,281 | 2/1990 | McCormick | 440/49 |
| 4,957,460 | 9/1990 | Harada et al. | 440/83 |

FOREIGN PATENT DOCUMENTS

| | | | |
|---|---|---|---|
| 510275 | 2/1955 | Canada | 440/49 |

*Primary Examiner*—Sherman Basinger
*Assistant Examiner*—Thomas J. Brahan
*Attorney, Agent, or Firm*—Michael, Best & Friedrich

[57] ABSTRACT

A marine propulsion device including a lower unit, a propeller shaft rotatably supported by the lower unit and to support a propeller, the shaft including a longitudinal axis and a surface defining a plane which is substantially normal to the axis, and a thrust washer for transmitting thrusting force from the propeller to the surface.

10 Claims, 1 Drawing Sheet

MARINE PROPULSION DEVICE

This application is a continuation of Ser. No. 510,167, filed Apr. 16, 1990, now abandoned.

BACKGROUND OF THE INVENTION

The invention relates generally to marine propulsion devices, and more specifically to marine propulsion devices having a thrust washer on the propeller shaft.

The use of thrust washers in marine propulsion devices to position a propeller on a propeller shaft and to transmit thrust from the propeller to the propeller shaft is known. In general, prior art thrust washers are machined with a frustoconical or tapered inner surface and are designed to be placed over the propeller shaft to engage a portion of the propeller shaft having a frustoconical or tapered outer surface. When the thrust washer is placed on the shaft, the tapered surface of the thrust washer engages the tapered surface of the propeller shaft. The engaged tapered surfaces form a contact zone. Both thrust loads developed by rotation of the propeller and any bending loads caused by hydrodynamic effects on the propeller are transferred from the propeller to the propeller shaft through the contact zone.

Prior art thrust washer designs present difficulty when the tapered surfaces of the propeller shaft and the thrust washer do not match. Poor manufacture or assembly of the thrust washer or the propeller shaft can result in mismatched tapered surfaces. Mismatched thrust washers and propeller shafts can result in a highly loaded contact zone which, in the worst case, is a line contact between the thrust washer and the shaft around the tapered portion of the propeller shaft. The smaller the contact zone, the greater the concentration of stress, and the greater the risk of failure due to fatigue. Accordingly, prior art designs require the expensive machining of the frustoconical mating surfaces on the thrust washer and the propeller shaft to narrow tolerance dimensions. Also, additional measures may have to be taken to assure that an assembled thrust washer and propeller shaft are properly matched.

Prior art thrust washer designs present additional difficulty, because the thrust washer acts on a tapered surface. Loads from the propeller are concentrated by the thrust washer on the reduced diameter portion of the shaft instead of on the larger diameter of the shaft. Bending loads on a reduced diameter also concentrate stress.

Attention is directed to the thrust washers disclosed in the following U.S. Patents: U.S. Pat. No. 4,793,773 issued to Kinouchi, et al on Dec. 27, 1988; U.S. Pat. No. 4,566,855 issued to Costabile, et al on Jan. 28, 1986; U.S. Pat. No. 4,545,771 issued to Iio on Oct. 8, 1985; U.S. Pat. No. 3,876,332 issued to Kashmerick on Apr. 8, 1975; U.S. Pat. No. 3,759,076 issued to Reese on Sep. 18, 1973; U.S. Pat. No. 3,444,932 issued to Wlezien on May 20, 1969; U.S. Pat. No. 3,389,558 issued to Hall on Jun. 25, 1968; and U.S. Pat. No. 3,335,803 issued to Van Ranst on Aug. 15, 1967.

SUMMARY OF THE INVENTION

The invention provides a marine propulsion device including a lower unit, a propeller shaft rotatably supported by the lower unit and adapted to be driven by an engine and to support a propeller, the shaft including a longitudinal axis and a first surface defining a plane which is substantially normal to the axis, and thrust washer means for transmitting thrusting force from the propeller to the surface.

In one embodiment, the shaft includes a generally cylindrical second surface, and a generally cylindrical third surface, and the first surface is located intermediate the second and third surfaces.

The invention also provides a marine propulsion device including a lower unit, a propeller shaft rotatably supported by the lower unit and adapted to be driven by an engine and to support a propeller, the shaft including a longitudinal axis, a first generally cylindrical surface having a first diameter, a second generally cylindrical surface having a second diameter, and a transition surface located intermediate the first and second cylindrical surfaces, the transition surface defining a plane which is substantially normal to the axis, and thrust washer means for transmitting thrusting force from the propeller to the transition surface, for transmitting bending forces from the propeller to the first cylindrical surface and for isolating the second cylindrical surface from bending forces from the propeller.

The invention also provides a marine propulsion device including a lower unit, a propeller shaft rotatably supported by the lower unit and adapted to be driven by an engine and to support a propeller, the shaft including a first generally cylindrical surface and a second generally cylindrical surface, and means for transmitting bending force from the propeller to the first surface and for isolating the second surface from bending force from the propeller.

A principal feature of the invention is the provision of a propeller shaft having a relatively large diameter for carrying the bending loads caused by hydrodynamic forces acting on the propeller, and a surface defining a plane normal to the axis of the propeller shaft for carrying the thrust loads developed by rotation of the propeller.

Another feature of the invention is the provision of a thrust washer and propeller shaft which afford the transfer of thrust and bending forces between the thrust washer and the propeller shaft through mating surfaces which are perpendicular to the components of force transmitted therethrough, thus eliminating expensive machining of frustoconical portions of the thrust washer and the propeller shaft.

Another feature of the invention is the provision of a thrust washer and propeller shaft which, along a portion of the shaft, are spaced apart to isolate the portion of the propeller shaft from the bending loads from the propeller.

Other features and advantages of the invention will become apparent to those skilled in the art upon review of the following detailed description, claims and drawings.

Figure 1:
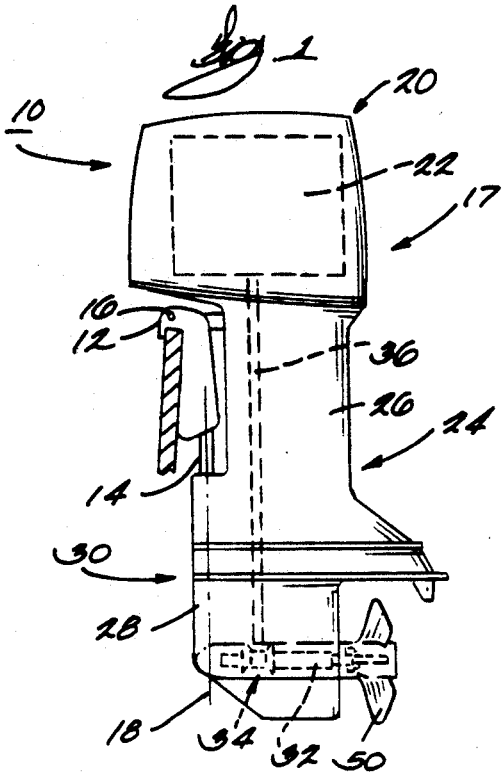
FIG. 1 is an elevation view of a marine propulsion device embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in FIG. 1 is a marine propulsion device 10 which is in the form of an outboard motor 10. However, the invention is applicable to other forms of marine propulsion devices, such as, for example, stern drive units. The marine propulsion device 10 shown in FIG. 1 includes a transom bracket 12 fixed to a boat transom and a swivel bracket 14 connected to the transom bracket 12 for pivotal movement relative thereto about a horizontal axis 16. The marine propulsion device 10 also includes a propulsion unit 17 connected to the swivel bracket 14 for pivotal movement relative thereto about a vertical axis 18 and for common movement therewith about the horizontal axis 16. The propulsion unit 17 includes a power head 20 which includes an internal combustion engine 22 and which is supported on a lower unit 24. In the illustrated embodiment, the lower unit 24 includes a drive shaft housing 26 and a gear case 28 which is fixed to the lower end 30 of the drive shaft housing 26.

The marine propulsion device 10 also includes a propeller shaft 32 which has a longitudinal axis 33, which is supported by the gear case 28 for rotation about the axis 33, and which is connected through a reversing transmission 34 to a drive shaft 36 that extends through the drive shaft housing 26 and that is driven by the engine 22.

Figure 2:
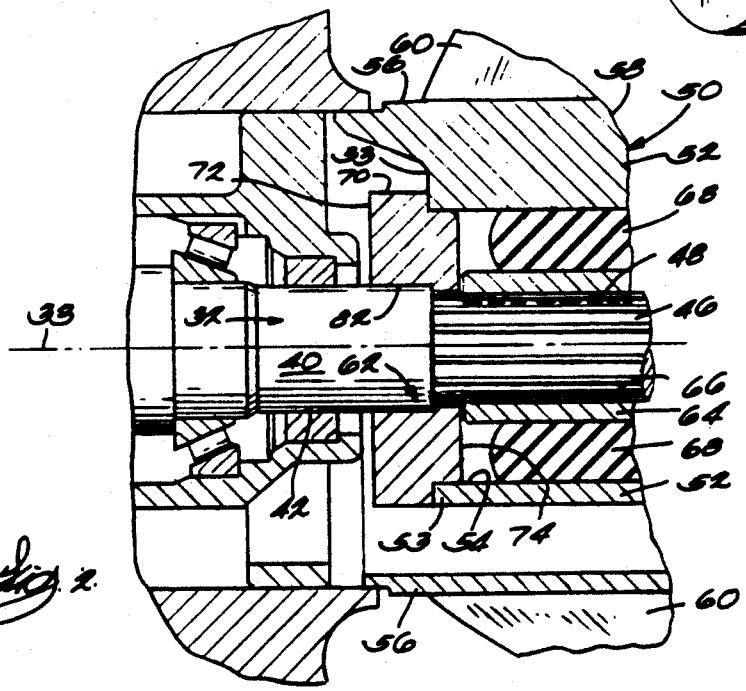
FIG. 2 is an enlarged view, in partial section, of a portion of the marine propulsion device shown in FIG. 1.

As shown in FIG. 2, the propeller shaft 32 includes a first portion 40 having a first generally cylindrical outer surface 42. The propeller shaft 32 also includes a transition surface 44 located rearwardly of the first portion 40. The transition surface 44 is generally perpendicular to the longitudinal axis 33 and defines a plane which is generally normal to the longitudinal axis 33. The propeller shaft 32 also includes a second portion 46 which extends rearwardly from the transition surface 44, which has a second generally cylindrical outer surface 48 and which has a diameter smaller than the diameter of the first portion 40. Thus, the transition surface 44 is located intermediate the first cylindrical surface 42 and the second cylindrical surface 48.

The marine propulsion device 10 also includes a propeller 50. The propeller 50 includes a generally cylindrical inner hub 52 having a forward rim 53 and an inner surface 54 which extends along the longitudinal axis 33 and which has a diameter sufficiently large to allow the inner hub 52 to house the second portion 46 of the shaft 32. The propeller 50 also has a generally cylindrical outer hub 56 which is spaced radially and outwardly from the inner hub 52. A plurality of webs or connecting members 58 (one of which is shown) extends between the inner hub 52 and the outer hub 56 to connect the inner hub 52 and outer hub 56. A plurality of propeller blades 60 extends radially and outwardly from the outer hub 56.

The marine propulsion device 10 also includes means 62 for mounting the propeller 50 on the propeller shaft 32. While various other constructions could be employed, in the illustrated embodiment, the means 62 for mounting the propeller 50 on the propeller shaft 32 includes a cylindrical sleeve 64 which is mounted on the second portion 46 of the propeller shaft 32. In order to transmit torque between the second portion 46 of the shaft 32 and the sleeve 64, in the preferred embodiment, the second portion 46 of the shaft 32 and the sleeve 64 are splined together at 66. In order to transmit torque to the inner hub 52 of the propeller 50 from the sleeve 64, the means 62 for mounting the propeller 50 on the shaft 32 also includes a generally annular resilient member or elastomeric ring 68 located between the sleeve 64 and the inner hub 52. The propeller 50 is driven by the propeller shaft 32 by a friction fit between the sleeve 64 and the elastomeric ring 68, and between the elastomeric ring 68 and the inner surface 54 of the inner hub 52. The elastomeric ring 68 transfers torque from the inner sleeve 64 to the propeller 50, but allows the propeller 50 to slip relative to the propeller shaft 32 in the event the propeller blades 60 hit an obstruction.

During operation of the marine propulsion device 10, the propeller 50 is driven by rotation of the propeller shaft 32. Driving rotation of the propeller 50 by the propeller shaft 32 and hydrodynamic effects created by driving the propeller 50 through water result in a combination of thrust loads, the components of force acting along a line parallel to the axis 33 of the propeller shaft 32, and bending loads, the components of force acting along a line which is normal to the axis 33, on the propeller shaft 32.

Figure 3:
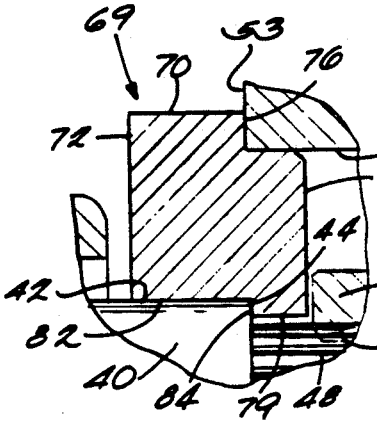
FIG. 3 is an enlarged view of a portion of FIG. 3.
Figure 4:
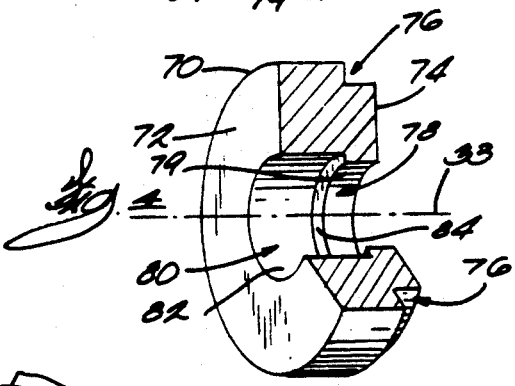
FIG. 4 is an enlarged perspective view in cross-section of a portion of the marine propulsion device shown in FIG. 1.

In order to transmit the loads from the propeller 50, the marine propulsion device 10 also includes means 69 for transmitting thrusting force from the propeller 50 to the transition surface 44, for transmitting bending forces from the propeller 50 to the first cylindrical surface 42 of the propeller shaft 32 and for isolating the second cylindrical surface 48 of the propeller shaft 32 from bending forces from the propeller 50. While various other arrangements could be employed, in the disclosed embodiment, the means 69 includes a thrust washer 70 mounted on the propeller shaft 32. The thrust washer 70 has a generally annular disk shape and, as best shown in FIG. 4, includes a forward face 72, a rearward face 74 and an annular notch 76 in the rearward face extending around the circumference of the thrust washer 70 and engaging the forward rim 53 of the inner hub 52. The washer 70 has therethrough a bore 78 extending parallel to the longitudinal axis 38. The bore 78 defines a first, generally cylindrical inner surface 79 which surrounds a length of the second portion 46 of the propeller shaft 32. As best shown in FIG. 3, the first inner surface 79 is spaced from the second portion 46 of the propeller shaft 32 and provides an annular clearance between the outer surface 48 of the second portion 46 of the shaft 32 and the first inner surface 79 of the thrust washer 70. The thrust washer 70 also includes a counterbore 80 extending partially therethrough. The counterbore 80 is coaxial with the bore 78 and extends through the forward face 72 toward the rearward face 74 and defines a second, generally cylindrical inner surface 82 which engages the first cylindrical surface 42 of the propeller shaft 32. The counterbore 80 also defines a shoulder 84 which engages the transition surface 44 of the propeller shaft 32. The shoulder 84 defines a surface which is generally perpendicular to the longitudinal axis 33 of the shaft 32. When the shoulder 84 and the transition surface 44 engage, substantially all of the shoulder 84 engages the transition surface 44 to maximize the area of contact between the transition surface 44 and the shoulder 84.

In the disclosed marine propulsion device 10, thrust and bending loads are transmitted from the propeller 50 to the propeller shaft 32 along two paths.

The first or primary path for transmission of loads from the propeller 50 to the shaft 32 is from the forward rim 53 of the inner hub 52 to the circumferential notch 76 on the thrust washer 70, and through the thrust washer 70 to the shaft 32. In the preferred embodiment, the mating fit between the thrust washer 70 and the first portion 40 of the shaft 32, and the fit between the inner hub 52 and the annular notch 76 are critical and are to close tolerances, so that a substantial portion of the forces from the propeller 50 are transmitted through the thrust washer 70 to the first portion 40 of the shaft 32.

Transmission of loads along the primary path results in the shaft 32 being subject to thrust forces transmitted to the transition surface 44. Because thrust forces from the propeller 50 are substantially equally distributed around the annular notch 76 of the thrust washer 70, and because the thrust washer 70 acts against the transition surface 44, which is normal to the direction of thrust forces, transmission of thrust forces through the thrust washer 70 does not subject the propeller shaft 32 to bending loads. Transmission of bending forces along the primary path are transmitted as bending forces to the first portion 40 of the shaft through the second inner surface 82 of the thrust washer 70. Because the first inner surface 79 of the thrust washer 70 is spaced from the surface 48 of the shaft 32, the second portion 46 of the propeller shaft 32 is substantially isolated from the bending forces transmitted along the primary path.

The secondary path for transmission of forces from the propeller 50 to the shaft 32 is from the inner hub 53 of the propeller 50 to the propeller shaft 32 through the elastomeric ring 68 and the sleeve 64.

Because the diameter of the first portion 40 of the propeller shaft 32 is larger than the diameter of the second portion 46, the first portion 40 of the propeller shaft 32 is better suited to bear the bending loads from the propeller 50. Also, because of the normal relationship between the axis 38 and the shoulder 84 on the thrust washer 70 and between the axis 38 and the transition surface 44 on the propeller shaft 32, the contact zone formed by the mating surfaces 84 and 44 can be maximized more consistently without expensive machining and inspection of tapered surfaces.

Various other features of the invention are set forth in the following claims:

1. A marine propulsion device comprising a lower unit, a propeller shaft rotatably supported by said lower unit and adapted to be driven by an engine and including a longitudinal axis, a forward, generally cylindrical surface, a rearward, generally cylindrical surface, and a shoulder surface which is intermediate said forward and rearward cylindrical surfaces and which is substantially normal to said axis, a propeller supported by said propeller shaft and including a hub having a forward transverse surface and a forwardly located inner cylindrical surface, and a thrust washer engaged between said forward transverse surface of said hub and said shoulder surface of said propeller shaft for transmitting thrusting force from said propeller to said propeller shaft, engaged between said inner cylindrical surface of said hub and said forward cylindrical surface of said propeller shaft for transmitting bending force from said propeller to said propeller shaft, and spaced from said rearward cylindrical surface of said propeller shaft to prevent transmission of bending force from said propeller to said propeller shaft through said second cylindrical surface.

2. A marine propulsion device as set forth in claim 1 wherein said shaft includes a generally cylindrical second surface, and a generally cylindrical third surface, and wherein said first surface is located intermediate said second and third surfaces.

3. A marine propulsion device as set forth in claim 2 wherein said thrust washer means is engageable with said second surface to transmit bending force from said propeller to said second surface and is isolated from said third surface to prevent transmission of bending force from the propeller to said propeller shaft through said third surface.

4. A marine propulsion device as set forth in claim 3 wherein said thrust washer means includes a thrust washer having therein a bore including a first inner surface engageable said generally cylindrical second surface, and a shoulder engaging said first surface.

5. A marine propulsion device as set forth in claim 4 wherein said bore includes a second inner surface surrounding and being spaced from said generally cylindrical third surface.

6. A marine propulsion device comprising a lower unit, a propeller shaft rotatably supported by said lower unit and adapted to be driven by an engine and to support a propeller, said shaft including a longitudinal axis, a first generally cylindrical surface having a first diameter, a second generally cylindrical surface having a second diameter, and a transition surface located intermediate said first and second cylindrical surfaces, said transition surface defining a plane which is substantially normal to said axis, a propeller supported by said propeller shaft and including a hub and a propeller blade extending from said hub, and a thrust washer engaged between said transition surface and said hub of said propeller for transmitting thrusting force from the propeller to said transition surface, engaged with said first cylindrical surface for transmitting bending forces from the propeller to said first cylindrical surface, and clear of said second cylindrical surface of said propeller shaft for isolating said second cylindrical surface from bending forces from the propeller.

7. A marine propulsion device as set forth in claim 6 wherein said first diameter is larger than said second diameter.

8. A marine propulsion device as set forth in claim 7 wherein said thrust washer means includes a thrust washer having therethrough a bore including a first inner surface surrounding said first cylindrical surface, a shoulder engaging said transition surface and a second inner surface surrounding said second cylindrical surface and being spaced from said second cylindrical surface.

9. A marine propulsion device comprising a lower unit, a propeller shaft rotatably supported by said lower unit and adapted to be driven by an engine and including a longitudinal axis and a forward, generally cylindrical surface, a rearward, generally cylindrical surface and a shoulder surface which is intermediate said forward and rearward cylindrical surfaces and which is substantially normal to said axis, a propeller supported by said propeller shaft and including a hub having a forward transverse surface and a forwardly located inner cylindrical surface, and a thrust washer engaged between said forward transverse surface of said hub and said shoulder surface of said propeller shaft for transmitting thrusting force from said propeller to said propeller shaft, and engaged between said inner cylindrical surface of said hub and said forward cylindrical surface of said propeller shaft for transmitting bending force from said propeller to said propeller shaft, said thrust washer including therein a bore including a forward inner surface engaging said forward generally cylindrical surface, and a rearward inner surface surrounding said rearward generally cylindrical surface.

10. A marine propulsion device as set forth in claim 9 wherein said forward generally cylindrical surface has a diameter, and wherein said rearward generally cylindrical surface has a diameter smaller than said diameter of said forward cylindrical surface.

* * * * *